United States Patent [19]

Blasczyk et al.

[11] Patent Number: 4,792,393

[45] Date of Patent: Dec. 20, 1988

[54] SPIRAL AIR SIFTER HAVING AIR REGULATION

[75] Inventors: Gotthardt Blasczyk; Hubert Eickholt, both of Beckum; Otto Heinemann, Ennigerloh; Norbert Bredenholler, Oelde; Ludger Kimmeyer, Beckum; Peter Tiggesbaumker, Oelde; Michael von Seebach; Heinrich Henne, both of Ennigerloh, all of Fed. Rep. of Germany

[73] Assignee: Krupp Polysius AG, Beckum, Fed. Rep. of Germany

[21] Appl. No.: 63,689

[22] Filed: Jun. 19, 1987

[30] Foreign Application Priority Data

Jul. 3, 1986 [DE] Fed. Rep. of Germany ..... 3622413

[51] Int. Cl.[4] ..... B07B 4/04; B07B 11/02

[52] U.S. Cl. ..... 209/135; 209/148; 209/154

[58] Field of Search ..... 209/144, 145, 148, 154, 209/134, 135, 139.2, 153; 55/459 B, 459 D

[56] References Cited

U.S. PATENT DOCUMENTS

| | | | |
|---|---|---|---|
| 2,913,109 | 11/1959 | Williams | 209/148 X |
| 3,015,392 | 1/1962 | Rozsa et al. | 209/144 |
| 3,503,502 | 3/1970 | Donelson, Jr. | 209/154 X |
| 4,236,997 | 12/1980 | Wessel et al. | 209/145 X |
| 4,296,864 | 10/1981 | Misaka et al. | 209/154 X |
| 4,551,241 | 11/1985 | Saverse et al. | 209/148 |
| 4,661,244 | 4/1987 | Hanke et al. | 209/148 X |

FOREIGN PATENT DOCUMENTS

| | | | |
|---|---|---|---|
| 3538832 | 5/1987 | Fed. Rep. of Germany | 209/145 |

*Primary Examiner*—Robert B. Reeves
*Assistant Examiner*—Edward M. Wacyra
*Attorney, Agent, or Firm*—Learman & McCulloch

[57] ABSTRACT

The invention relates to a sifter in which the spiral for delivery of the air for sifting is divided into a plurality of channels lying one above another in which elements for setting the quantity of sifting air delivered to the individual channels are provided. In such a sifter the quantity of sifting air in the individual regions of the sifting chamber can be optimally adapted to the requirements, which leads to a substantial improvement in the degree of separation.

11 Claims, 2 Drawing Sheets

SPIRAL AIR SIFTER HAVING AIR REGULATION

The invention relates to a sifter for the separation of fine and coarse materials through the circulation of sifting air.

BACKGROUND OF THE INVENTION

A sifter of the general type described is known for example, from U.S. Pat. No. 4,296,864. In this publication the sifting chamber is formed by an annular space which is present between stationary air baffles arranged at the outlet end of a sifting air supply spiral and rotor blades. The material for sifting is delivered to the upper end face of the rotor, carried outwards and deflected into the sifting chamber through which it then passes downwards. Whereas the coarse material falls downwards out of the sifting chamber, the fine material is carried with the sifting air into the rotor and leaves the rotor together with the sifting air through the upper or lower end.

SUMMARY OF THE INVENTION

The object of this invention is to make further developments to such sifters in such a way that the degree of separation is improved and in particular the coarse material is prevented from being carried along with the sifting air which is charged with fine material.

Exhaustive tests on the known sifter referred to above showed that the degree of separation was frequently found to be unsatisfactory, and in particular the danger of coarse material being carried along in the air stream which is charged with fine material is caused by less than optimal air distribution over the height of the sifting chamber. Since the material for sifting is introduced from above into the sifting chamber and as it passes downwards through the sifting chamber more and more fine material comes out, there is a reduction in the material charge in the lower region of the sifting chamber. If on the other hand the sifting air is extracted through the lower end of the rotor, then the sifting air delivered through the spiral endeavours to pass through the sifting chamber predominantly in the lower region. This results in increased flow speeds in the lower region of the sifting chamber which easily leads to particles of coarse material being carried along into the fine material chamber.

Therefore, according to this invention the spiral for delivering the sifting air is divided by partitions into at least two channels which lie one above the other and out of which the sifting air flows into the sifting chamber at different heights. This prevents the sifting air from only passing through a part of the height of the sifting chamber.

The individual channels are also provided according to the invention with elements for setting the quantity and/or speed of the sifting air delivered through the individual channels. In this way the quantity and/or the speed of the sifting air flowing into the individual regions of the height of the sifting chamber can be adapted to the particular conditions, and in particular to the material charge in the individual regions of the sifting chamber. If the distribution of the sifting air in the vertical direction is controlled and set in this way before it enters the sifting chamber, then the sifting air is prevented from flowing in greater quantity into the lower region of the sifting chamber and there causing particles of coarse material to be carried along into the fine material chamber, whilst the sifting in the upper region of the sifting chamber is impaired at the same time. Therefore the setting facility according to the invention makes it possible to achieve a substantial improvement in the degree of separation of the sifter.

THE DRAWINGS

One embodiment of the invention is illustrated in the drawings, wherein.

DETAILED DESCRIPTION

Figure 1:
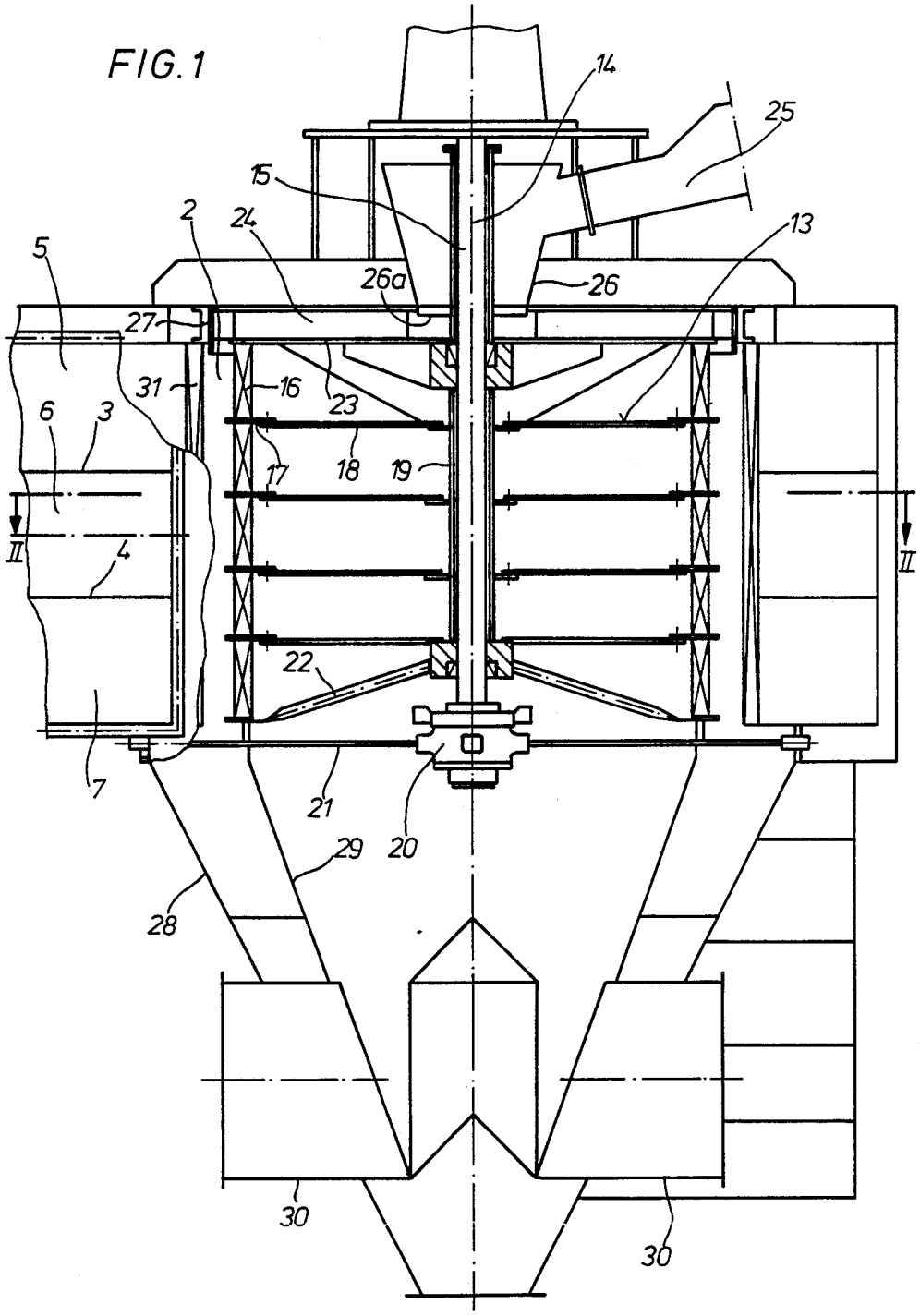
FIG. 1 shows a vertical section through a sifter embodying the invention.
Figure 3:
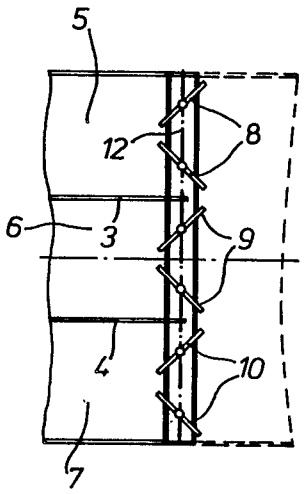
FIG. 3 shows a section along the line III—III in FIG. 2.

The housing of the illustrated sifter contains in its upper region a spiral 1 which serves for delivery of the sifting air, and which opens tangentially into the sifting chamber 2 and is divided by two horizontal partitions 3, 4 into three channels 5, 6 and 7 which lie one above another. In the inlet region of the spiral (cf. FIGS. 2 and 3) elements constructed as adjustable valves 8, 9, 10 are provided for setting the quantity of air delivered to the individual channels 5, 6, 7. The valves 8, 9, 10 are arranged in pairs and are actuated for example by adjusting levers 11 and chains 12, the valves 8, 9, 10 being adjustable independently of one another.

A rotor 13 which is rotatable about a vertical axis 14 and driven via a shaft 15 by a motor (not shown) is arranged in the sifter housing.

The rotor 13 is provided on its periphery with rotor blades 16 which are carried by annular discs 17 which are connected via struts 18 to a bush 19 surrounding the shaft 15. The shaft 15 is mounted at the lower end in a bearing 20 borne by radial struts 21. The lower end of the rotor 13 is of open construction and has radially extending struts 22.

The upper end of the rotor 13 is formed by a plate 23 which carries distributor strips 24 arranged radially on its upper surface.

An air conveyor chute 25 to which a bell-type distributor is connected serves for delivery of the sifting material to the plate 23, the said bell-type distributor coaxially encloses the shaft 15 and the lower opening 26a thereof opens over the center of the plate 23.

A deflector ring 27 which deflects sifting material thrown off from the plate 23 downwards into the sifting chamber 2 is provided at a distance from the circumference of the plate 23.

In the lower region the sifter housing is provided with a hopper 28 for removal of the coarse material. In addition, below the open lower end of the rotor 13 is located a further hopper 29 to which a plurality of connections 30 (for example four connections 30 evenly distributed over the periphery) are connected in the illustrated embodiment.

Figure 2:
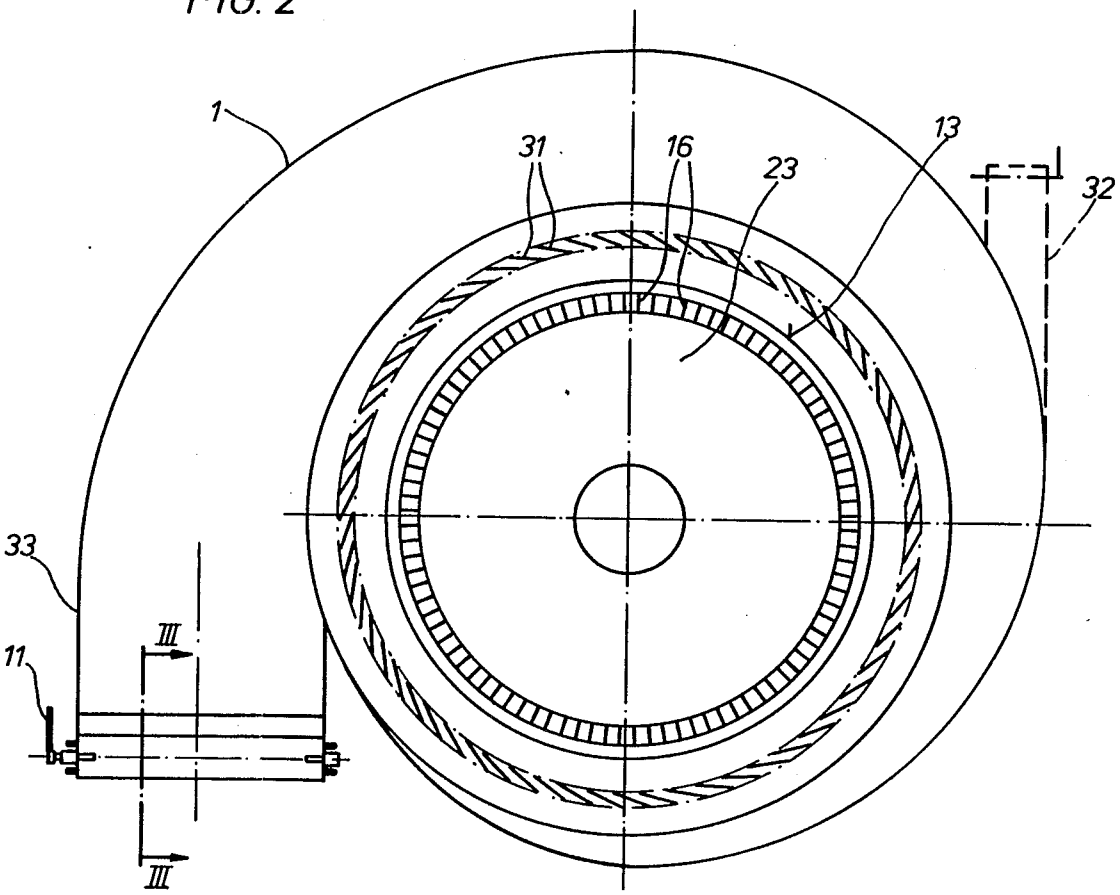
FIG. 2 shows a section along the line II—II in FIG. 1.

Air baffle elements 31 are provided at the outlet end of the spiral 1 for delivery of the sifting air. As FIG. 2 shows, these air baffle elements 31 are inclined in the direction of flow of the sifting air which flows approximately tangentially into the sifting chamber 2.

The illustrated sifter functions as follows:

The material for sifting is delivered in even distribution to the centre of the plate 23 via the air conveyor chute 25 and the bell-type distributor, conveyed outwards by the movement of the rotor 13 and rendered even more even by the distributor strips 24. The material for sifting is thrown off of the plate 23 with a moderate speed component and deflected downwards through the deflector ring 27. It then passes downwards through the sifting chamber 2 in the form of a haze of material.

The sifting air is delivered via the channels 5, 6 and 7 of the spiral 1, and by adjusting the valves 8, 9, 10 the quantity of sifting air flowing into the individual regions of the height of the sifting chamber 2 are optimally adapted to the particular conditions. Since in general there is a greater material charge in the upper region of the sifting chamber 2, it is usually advantageous to operate the upper channel 5 with a greater quantity of air than the lower channel 7.

The fine material and coarse material are separated in the sifting chamber 2. Whereas the coarse material falls downwards and is removed through the hopper 28, the fine material passes together with the sifting air into the interior of the rotor 13 and is removed via the connections 30. The air baffles 31 at the outlet end of the spiral 1 serve to maintain the rotational flow of the air, whilst the rotor blades 16 predominantly fulfil the task of prevent any particles of coarse material adhering to the fine material from entering the interior of the rotor 13.

The sifting air which is removed via the connections 30 and charged with fine material passes to one or more external separators in which the fine material (finished material) is separated from the sifting air. The sifting air can then be delivered, via an external air-circulating fan back to the spiral 1, when operating with circulating air. However, instead of this it is also possible to discard the sifting air which has been freed of fine material (possibly after further dust removal) and to draw in the sifting air from the surroundings thus providing a single transit of sifting air through the sifter.

Different variants are possible within the scope of the invention. For example the sifting air charged with fine material can also be extracted through the upper end of the rotor. In this case instead of a closed plate 23 on the upper end of the rotor a system of channels arranged in star formation is advantageously provided in which the channels are open only at their inner and outer ends and through which the material for sifting which is delivered centrally via the belt-type distributor 26 is passed to the sifting chamber 2.

Furthermore, whereas in the illustrated embodiment the spiral is divided into three channels 5, 6, 7 arranged one above another, it is of course possible within the scope of the invention to provide only two or more than three channels.

A further variant is indicated by broken lines in FIG. 2. Here the spiral 2 also has a second air inlet opening 32 which is offset on the periphery by approximately 180° with respect to the other air inlet opening 33. Elements (e.g. valves) for setting the quantity of air delivered through the individual channels are also provided in the region of this second air inlet opening 32. The maintenance of the rotational flow with which the sifting air enters the sifting chamber 2 is favoured by such additional air inlet openings.

As a result of the setting facility according to the invention not only is a substantial improvement in the degree of separation of the sifter achieved, but also the specific air requirement of the sifter as a whole is reduced, which makes a considerable saving of energy possible.

What is claimed is:

1. In a sifter:

(a) a housing provided with spiral sifting air delivery means having an inlet and outlet opening tangentially into a sifting chamber, a hopper for removal of coarse material, and at least one outlet for removal of sifting air containing fine material;

(b) a rotor having rotor blades on its periphery and rotatable about a vertical axis, said rotor having in the region of one end thereof an opening for the escape of the sifting air containing fine material; and (c) means for delivering material to be sifted to the upper end of the rotor and for deflecting the material which is moved outwards by the rotor, so that the material to be sifted passes downwards through an annular sifting chamber;

the improvement comprising:

(d) partition means dividing said spiral delivery means into at least two channels lying one above the other from which sifting air flows into the sifting chamber at different heights, and (e) regulating means for individually setting the quantity and speed of the sifting air delivered through each of said channels.

2. A sifter according to claim 1 wherein said regulating means comprises adjustable valves at the inlet of said spiral delivery means.

3. A sifter according to claim 1 wherein said spiral delivery means has a plurality of air inlet openings distributed around its periphery, and including elements adjacent each air inlet opening for setting the quantity of air delivered through the individual channels.

4. A sifter according to claim 1 including a bell-type distributor arranged coaxially with the axis of the rotor, and an air conveyor chute opening into said distributor for the supply of material to be sifted to the upper end of the rotor.

5. A sifter according to claim 1 wherein the lower end of the rotor is open and including at least one outlet in the lower region of the sifter housing for removal of the sifting air charged with fine material.

6. A sifter according to claim 5 including a horizontal plate at the upper end of the rotor for distributing said material, and distributor strips arranged radially on the upper face of said plate.

7. A sifter according to claim 1 including a bearing mounting said rotor at its lower end, and radial struts supporting said bearing and said rotor.

8. In a sifter:

(a) a housing defining a sifting chamber provided with spiral sifting air duct means having an inlet external of said housing and an outlet opening tangentially into said sifting chamber, a hopper for removal of coarse material, and at least one sifting air outlet for removal of sifting air containing fine material;

(b) a rotor having rotor blades on its periphery and rotatable about a vertical axis, said rotor having in the region of one end thereof an opening for the escape of the sifting air containing fine material; and (c) means for delivering material to be sifted to the upper end of the rotor and means for deflecting downwardly the material which is moved outwards of said axis by the rotor;

the improvement comprising:

(d) partition means dividing said spiral duct means over substantially its entire length into at least two channels lying one above the other and through which sifting air flows into the sifting chamber at different heights, and (e) adjustable regulating means occupying each of said channels and being adjustable independently of one another for setting the quantity and speed of the sifting air delivered through each of said channels.

9. A sifter according to claim 8 wherein said regulating means comprises adjustable valves at the inlet of said duct means.

10. A sifter according to claim 8 including vertical baffles at the outlet of said duct means and inclined to be substantially tangential to said rotor.

11. A sifter according to claim 10 wherein each of said baffles spans the vertical height of the outlet of said duct means.

* * * * *